US007185874B2

(12) United States Patent
Deiss et al.

(10) Patent No.: US 7,185,874 B2
(45) Date of Patent: Mar. 6, 2007

(54) FASTENING ELEMENT FOR FASTENING A DOMESTIC APPLIANCE

(75) Inventors: Ulrich Deiss, Sontheim (DE); Bernd Schessl, Dillingen (DE); Ernst Stickel, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/873,390

(22) Filed: Jun. 21, 2004

(65) Prior Publication Data

US 2004/0227043 A1 Nov. 18, 2004

Related U.S. Application Data

(63) Continuation of application No. PCT/EP02/12948, filed on Nov. 19, 2002.

(30) Foreign Application Priority Data

Dec. 21, 2001 (DE) ..... 101 63 182

(51) Int. Cl.
*F16M 3/00* (2006.01)

(52) U.S. Cl. ..... 248/680; 248/674

(58) Field of Classification Search ..... 248/231.9, 248/27.1, 674, 675, 201, 300, 677, 680, 500; 312/228, 228.1, 296, 257.1
See application file for complete search history.

(56) References Cited

U.S. PATENT DOCUMENTS 1,917,450 A * 7/1933 Lademann ..... 248/231.9
5,104,071 A * 4/1992 Kowalski ..... 248/27.1
5,598,680 A * 2/1997 Wilhelmi ..... 52/715
5,709,359 A * 1/1998 Riley ..... 248/201
6,241,206 B1 * 6/2001 Kam ..... 248/247
6,315,489 B1 * 11/2001 Watanabe ..... 403/381
6,412,745 B1 * 7/2002 Yokoyama et al. ..... 248/500
6,439,523 B1 * 8/2002 Chandler et al. ..... 248/300
2003/0230955 A1 * 12/2003 Welch ..... 312/228

FOREIGN PATENT DOCUMENTS

| | | |
|---|---|---|
| DE | 1 451 110 | 5/1969 |
| DE | 1 501 276 | 10/1969 |
| DE | 25 42 986 A1 | 3/1977 |
| DE | 296 21 598 U1 | 4/1997 |
| GB | 2 159 618 A | 12/1985 |

* cited by examiner

*Primary Examiner*—Ramon O Ramirez
(74) *Attorney, Agent, or Firm*—Russell W. Warnock; Craig J. Loest

(57) ABSTRACT

A fixing element is provided for fixing a household appliance to a part of the kitchen cabinetry, which is adjacent to the household appliance. The fixing element is configured as a fixation lug and is disposed between the household appliance and the part substantially at least over the total height of the part of the kitchen cabinetry. A compact fixing element is thus obtained, which permits a precise, stable, easy and economic fixation of the household appliance into an opening in the kitchen cabinetry. Another advantage of the lateral fixing element is the clean and pleasant aspect thereof. Moreover, flexible use of only one type of fixing element is possible, due to the fact that the element can be used independently of the counter top material as well as in case of elevated mounting of the appliance or in case of a cutout counter top.

18 Claims, 1 Drawing Sheet

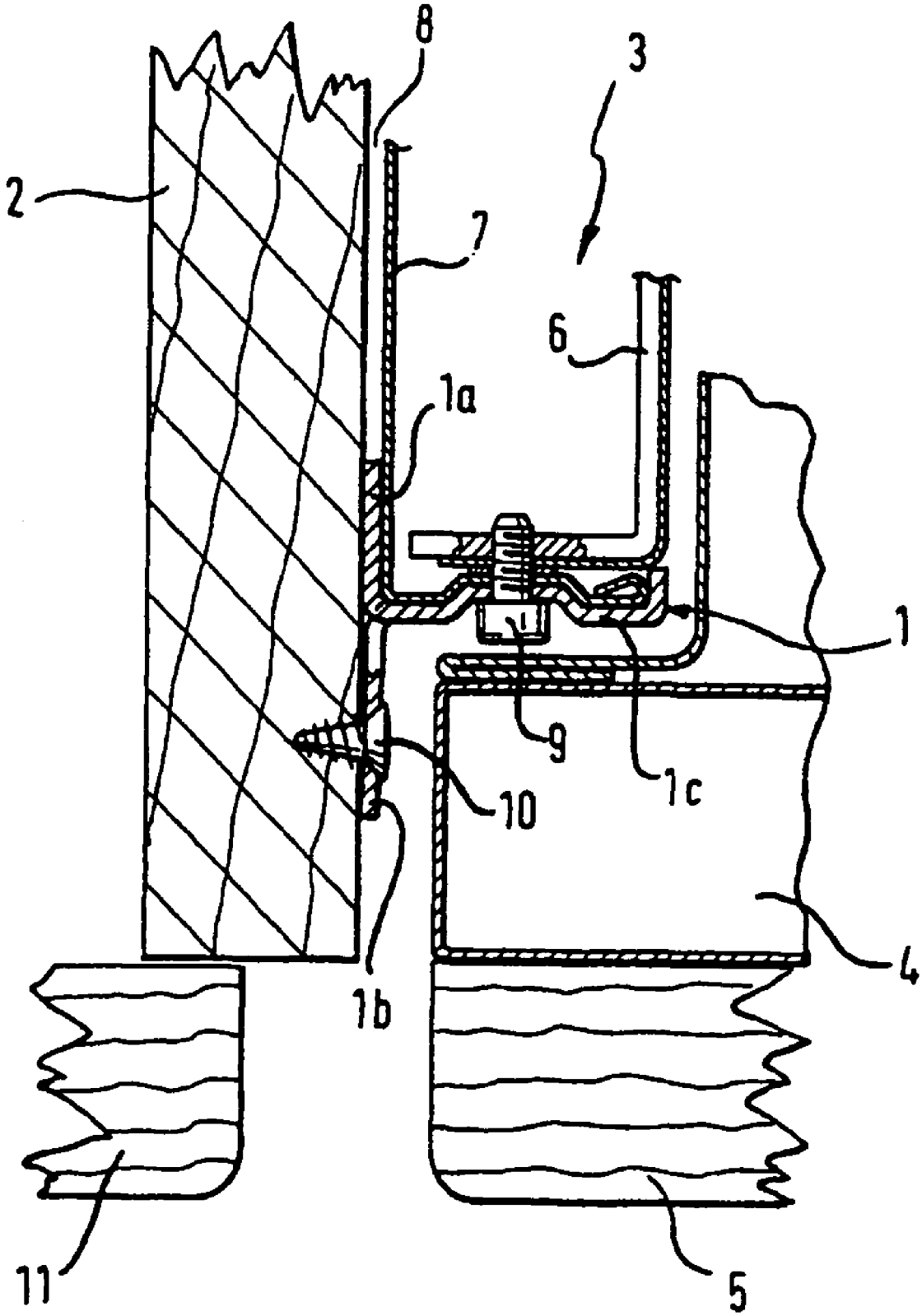
8
3
2
7
6
1a
1
9
1c
10
4
1b
11
5

FASTENING ELEMENT FOR FASTENING A DOMESTIC APPLIANCE

CROSS-REFERENCE TO RELATED APPLICATION

This application is a continuation, under 35 U.S.C. § 120, of copending international application No. PCT/EP02/12948, filed Nov. 19, 2002, which designated the United States; this application also claims the priority, under 35 U.S.C. § 119, of German patent application No. 101 63 182.0, filed Dec. 21, 2001; the prior applications are herewith incorporated by reference in their entirety.

BACKGROUND OF THE INVENTION

Field of the Invention

The invention relates to a fastening element for fastening a domestic appliance in kitchen cabinetry or the like. The fastening element has a connecting element for connecting both to the domestic appliance and to at least one unit part of the kitchen cabinetry that is disposed adjacent to the domestic appliance.

Fastening tongues or lugs that project forward in the horizontal direction and are provided with bores for accommodating screws are usually provided for the installation of a domestic appliance, for example a dishwasher, in the kitchen cabinetry or the like beneath a counter top. A plurality of screws are screwed from beneath, through the bores of the fastening tongues or lugs, into the counter top located above, and projecting in relation to the front side of the appliance, the domestic appliance being fastened in this way. This works with counter tops that are produced from a timber material, but not with counter tops made of marble or stone.

For fastening a domestic appliance beneath a counter top of the kitchen cabinetry according to German Utility Model DE 296 21 598, the counter top being produced from stone materials, it is thus possible to use a connecting element for the connection both to the domestic appliance and to at least one adjacent unit part of the kitchen cabinetry. The connecting element has two fastening regions, of which one is to be screwed either to the underside of the front overhang of the counter top or to the lateral overhang, in relation to the domestic appliance, of adjacent unit parts and the other is to be connected releasably in a form-fitting manner to the domestic appliance.

SUMMARY OF THE INVENTION

It is accordingly an object of the invention to provide a fastening element for fastening a domestic appliance which overcomes the above-mentioned disadvantages of the prior art devices of this general type, which fastens the domestic appliance as easily as possible in an opening in the kitchen cabinetry.

With the foregoing and other objects in view there is provided, in accordance with the invention, a fastening element for fastening a domestic appliance to kitchen cabinetry. The fastening element contains a connecting element for connecting the domestic appliance to at least one unit part of the kitchen cabinetry disposed adjacent the domestic appliance. The connecting element is configured as a fastening strip and is disposed laterally between the domestic appliance and the unit part such that the fastening strip continues substantially at least over an entire height of the unit part.

The connecting element for the connection both to the domestic appliance and to at least one unit part of the kitchen cabinetry which is adjacent to the domestic appliance is configured, according to the subject matter of the invention, as a fastening strip and is disposed between the domestic appliance and the unit part such that it continues at least over the entire height of the unit part. This produces a compact fastening element that results in precise, captive fastening of the domestic appliance in the opening in the kitchen cabinetry in a straightforward and inexpensive manner. A further advantage of the lateral continuous fastening strip according to the invention over known solutions is in the clean, pleasing appearance. It is also the case that use of the fastening strip irrespective of the material of the work top—be this made of wood, marble, stone or some other material—as well as for elevated installation of the domestic appliance and in the case of a cut-out counter top allows the flexible use of just one type of fastening element. There is no need for additional parts for the fastening element to be supplied along with it or thereafter. The storage of different fastening elements that are adapted individually in each case to the type of installation or built-in appliance is done away with.

The fastening strip is preferably disposed in a gap that runs laterally between the domestic appliance and the unit part.

It has proven favorable, according to a development of the invention, for the fastening strip to be configured as an angled strip or as a T-shaped strip. The angled strip results in minimal material consumption with nevertheless sufficient stable fastening, whereas the T-shaped strip provides even more stability for fastening the domestic appliance.

It is advantageous, according to another development of the invention, if the fastening strip has a plurality of fasteners which are each disposed for the releasable connection to the frame of the domestic appliance and to the unit part. This assists the precise, captive fastening of the domestic appliance in the opening over the entire length of the fastening strip, essentially at least over the entire height of the unit part. According to a preferred configuration, the fasteners are distributed uniformly along the gap.

It is further advantageous if the fastening element is disposed in each case on both sides of the domestic appliance for the connection to the unit parts adjacent to the domestic appliance, which increases the stability of the overall configuration containing fastening elements and domestic appliance and unit parts.

The fastening element according to the invention can advantageously be used for any desired domestic appliances, but particularly for dishwashers.

Other features which are considered as characteristic for the invention are set forth in the appended claims.

Although the invention is illustrated and described herein as embodied in a fastening element for fastening a domestic appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single figure of the drawing is a diagrammatic, sectional view of a fastening element with a fastening strip according to the invention.

DESCRIPTION OF THE PREFERRED EMBODIMENTS

Referring now to the single figure of the drawing in detail, there is shown a fastening element with a fastening strip 1 according to the subject matter of the invention. The fastening strip 1 connects a domestic appliance, in the exemplary embodiment a dishwasher 3, to an adjacent unit part 2 of the kitchen cabinetry, in a releasable manner. The drawing shows a plan view of a section through a sidewall of the unit part 2 and a sidewall of the dishwasher 3.

The dishwasher 3 has, as is known, for accommodating articles which are to be washed, a dishwashing compartment which is as generously dimensioned as possible and can be opened and closed by an appliance door 4 which, in the case of a built-in dishwasher illustrated in the exemplary embodiment shown, has an attached unit facing panel 5 which, for the purpose of matching the front side of the appliance to the appearance of the kitchen cabinetry, is preferably identical, for example, to a unit door 11 of the adjacent unit part 2. For the sake of simplicity, just one adjacent unit part 2 is shown, the fastening strip 1 for fastening the domestic appliance in the opening in the kitchen cabinetry being fitted thereon. It is preferable for a further such fastening strip 1 also to be provided on the other side of the dishwasher 3 for releasable connection to another adjacent unit part.

The dishwasher 3 rests on a floor and the unit part 2 of the kitchen cabinetry has a height that is measured vertically from the floor to a counter top location above the unit part 2 at which a counter top extends over both the unit part 2 and the built-in dishwasher 3.

The fastening strip 1 is disposed such that it continues essentially at least over the entire height of the unit part 2—i.e. for example approximately from the bottom edge of the counter top disposed above the dishwasher 3 as far as the hinge located in the floor region—preferably in a gap 8 which runs laterally between appliance wall 7 of the dishwasher 3 and the unit part 2. In the present example, the fastening strip 1 is configured as a T-shaped strip with a vertically running transverse crosspiece 1*c*, which in the exemplary embodiment shown extends widthwise over the entire width of an appliance frame 6, and with two longitudinal crosspieces 1*a* and 1*b* which are each angled through 90 degrees in different directions in relation to the transverse crosspiece 1*c*. In this case, the longitudinal crosspieces 1*a* and 1*b* are located in the gap 8 between the unit part 2 and dishwasher 3. The fastening strip 1 has, in the transverse crosspiece 1*c*, at least one bore for accommodating a first fastener 9 in the form of a fastening screw for releasable connection to the appliance frame 6 and, in the longitudinal crosspiece 1*b*, at least one further bore for accommodating a second fastener 10 in the form of a further fastening screw for releasable connection to the unit part 2. The fasteners 9, 10 are disposed—preferably distributed uniformly—at a number of locations along the fastening strip 1, which runs essentially at least over the entire height of the unit part 2. The bores for the fastening screws 10 each contain slots for arresting the domestic appliance on a provisional basis and round holes for fixing it definitively. For better mounting of the fastening screws 9, the transverse crosspiece 1*c* of the fastening strip 1 is recessed inwards to a slight extent in a U-shaped manner. Furthermore, the transverse crosspiece 1*c* has an inwardly curved termination edge at its end. Optimum fastening of the dishwasher 3 in the opening of the kitchen cabinetry is assisted by the fastening strip 1 by at least four fastening screws being fitted thereon on the left/right and at the top/bottom on both sides of the domestic appliance, alongside the two adjacent unit parts 2 of the niche or opening.

As an alternative, the fastening strip 1 can also be used as an angled strip with the horizontally running transverse crosspiece 1*c* and with just one longitudinal crosspiece 1*b* which is angled through 90 degrees in one direction in relation to the transverse crosspiece 1*c*. The angled strip results in minimal material consumption with nevertheless sufficient stable fastening.

The fastening strip 1 according to the invention produces a compact fastening element that results in precise captive fastening of the domestic appliance in the opening in the kitchen cabinetry in a straightforward and inexpensive manner. A further advantage of the lateral continuous fastening strip according to the invention over known solutions is in the clean, pleasing appearance. It is also the case that use of the fastening strip 1 irrespective of the material of the counter top—be this made of wood, marble, stone or some other material—as well as for elevated installation of the domestic appliance and in the case of a cut-out counter top allows flexible use of just one type of fastening element.

We claim:

1. A fastening element for fastening a domestic appliance to at least one unit part of kitchen cabinetry disposed adjacent the domestic appliance, the domestic appliance being supported on a floor and the at least one unit part of kitchen cabinetry disposed adjacent the domestic appliance being a structure whose entire height is measured vertically from the floor to a counter top location above the unit part of kitchen cabinetry at which a counter top extends, the fastening element comprising:

a connecting element for connecting the domestic appliance to at least one unit part of the kitchen cabinetry disposed adjacent the domestic appliance, said connecting element configured as a fastening strip disposable laterally between the domestic appliance and the unit part such that said fastening strip continues substantially at least over the entire height of the unit part.

2. The fastening element according to claim 1, wherein said fastening strip is disposed in a gap which runs laterally between the domestic appliance and the unit part.

3. The fastening element according to claim 1, wherein said fastening strip is configured as an angled strip.

4. The fastening element according to claim 1, wherein said fastening strip is a T-shaped strip.

5. The fastening element according to claim 1, wherein said fastening strip has a plurality of fasteners which are each disposed for a releasable connection to a frame of the domestic appliance and to the unit part.

6. The fastening element according to claim 5, wherein said fasteners are distributed uniformly over the entire height of the unit part.

7. The fastening element according to claim 1, wherein said fastening element is two fastening strips and said fastening strips are disposed on both sides of the domestic appliance for connecting to unit parts adjacent to the domestic appliance.

8. The fastening element according to claim 1, wherein the domestic appliance is a dishwasher and said fastening strip is configured for connecting to said dishwasher.

9. The fastening element according to claim 1, wherein said said fastening strip has a vertically running transverse crosspiece that continues substantially at least over an entire height of the unit part.

10. The fastening element according to claim 1, wherein said said fastening strip has two longitudinal crosspieces each angled through 90 degrees in different directions in relation to the transverse crosspiece.

11. The fastening element according to claim 1, wherein each of said longitudinal crosspieces has at least one bore for accommodating a first fastener for releasable connection to the domestic appliance and at least one further bore for accommodating a second fastener for releasable connection of said fastening element to the at least one unit part of the kitchen cabinetry.

12. A fastening element for fastening a domestic appliance to at least one unit part of kitchen cabinetry disposed adjacent the domestic appliance, the domestic appliance being supported on a floor and the at least one unit part of kitchen cabinetry disposed adjacent the domestic appliance being a structure whose entire height is measured vertically from the floor to a counter top location above the unit part of kitchen cabinetry at which a counter top extends, the fastening element comprising:

a connecting element for connecting the domestic appliance to at least one unit part of the kitchen cabinetry disposed adjacent the domestic appliance, said connecting element configured as a fastening strip disposable laterally between the domestic appliance and the unit part such that said fastening strip continues substantially at least over the entire height of the unit part and said fastening strip having a vertically running transverse crosspiece and two longitudinal crosspieces each angled through 90 degrees in different directions in relation to the transverse crosspiece.

13. The fastening element according to claim 12, wherein each of said longitudinal crosspieces has at least one bore for accommodating a first fastener for releasable connection to the domestic appliance and at least one further bore for accommodating a second fastener for releasable connection of said fastening element to the at least one unit part of the kitchen cabinetry.

14. A fastening element for fastening a domestic appliance to at least one unit part of kitchen cabinetry disposed adjacent the domestic appliance, the domestic appliance being supported on a floor and the at least one unit part of kitchen cabinetry disposed adjacent the domestic appliance being a structure whose entire height is measured vertically from the floor to a counter top location above the unit part of kitchen cabinetry at which a counter top extends, the fastening element comprising:

a connecting element for connecting the domestic appliance to at least one unit part of the kitchen cabinetry disposed adjacent the domestic appliance, said connecting element configured as a fastening strip disposable laterally between the domestic appliance and the unit part such that said fastening strip continues substantially at least over an entire height of the unit part and said fastening strip having a vertically running transverse crosspiece that continues substantially at least over the entire height of the unit part.

15. The fastening element according to claim 14, and further comprising two longitudinal crosspieces each angled through 90 degrees in different directions in relation to the transverse crosspiece.

16. The fastening element according to claim 15, wherein each of said longitudinal crosspieces has at least one bore for accommodating a first fastener for releasable connection to the domestic appliance and at least one further bore for accommodating a second fastener for releasable connection of said fastening element to the at least one unit part of the kitchen cabinetry.

17. The fastening element according to claim 14, wherein said fastening strip has a plurality of fasteners which are each disposed for a releasable connection to a frame of the domestic appliance and to the unit part.

18. The fastening element according to claim 17, wherein said fasteners are distributed uniformly over the entire height of the unit part.

* * * * *